United States Patent [19]

Meschi

[11] Patent Number: 4,507,109

[45] Date of Patent: Mar. 26, 1985

[54] APPARATUS FOR RECEPTION AND TRANSFER OF SHEET MATERIAL

[75] Inventor: Luciano Meschi, Leghorn, Italy

[73] Assignee: Wully, S.A., Panama, Panama

[21] Appl. No.: 343,820

[22] Filed: Jan. 29, 1982

[30] Foreign Application Priority Data

Feb. 2, 1981 [IT] Italy ..... 19460 A/81

[51] Int. Cl.[3] ..... B65H 45/16

[52] U.S. Cl. ..... 493/356; 493/412; 493/410; 493/413; 414/46; 414/53

[58] Field of Search ..... 226/109, 110; 271/303; 414/45, 46, 53; 493/356, 359, 410, 411, 412, 413, 414, 415, 425, 430, 432, 433

[56] References Cited

U.S. PATENT DOCUMENTS

| | | | |
|---|---|---|---|
| 3,729,188 | 4/1973 | Stephenson | 271/303 |
| 3,980,183 | 9/1976 | Anikanov et al. | 271/303 X |
| 4,111,411 | 9/1978 | Graves et al. | 271/303 X |
| 4,131,272 | 12/1978 | Hartnig | 493/433 X |
| 4,205,836 | 6/1980 | Nystrand | 493/430 X |
| 4,240,340 | 12/1980 | Roy | 414/45 X |
| 4,277,061 | 7/1981 | Nagel et al. | 271/303 X |

FOREIGN PATENT DOCUMENTS

| | | | |
|---|---|---|---|
| 983063 | 2/1976 | Canada | 226/110 |
| 171367 | 5/1965 | U.S.S.R. | 271/303 |

*Primary Examiner*—Robert L. Spruill
*Assistant Examiner*—Steven P. Weihrouch
*Attorney, Agent, or Firm*—McAulay, Fields, Fisher, Goldstein & Nissen

[57] ABSTRACT

Within electroaccounting and data processing centers, the sheets of forms processed by the printing machine, in particular by a laser or fast printing machine, are shaped as a continuous strip, which by means of the apparatus in accordance with the invention is assembled into packages wherein the strip is folded, and the packages are automatically shaped, separated from the strip that comes from the printing machine and transferred to successive processing in a continuous manner without interfering with the printing machine operation.

2 Claims, 8 Drawing Figures

Figure 1:
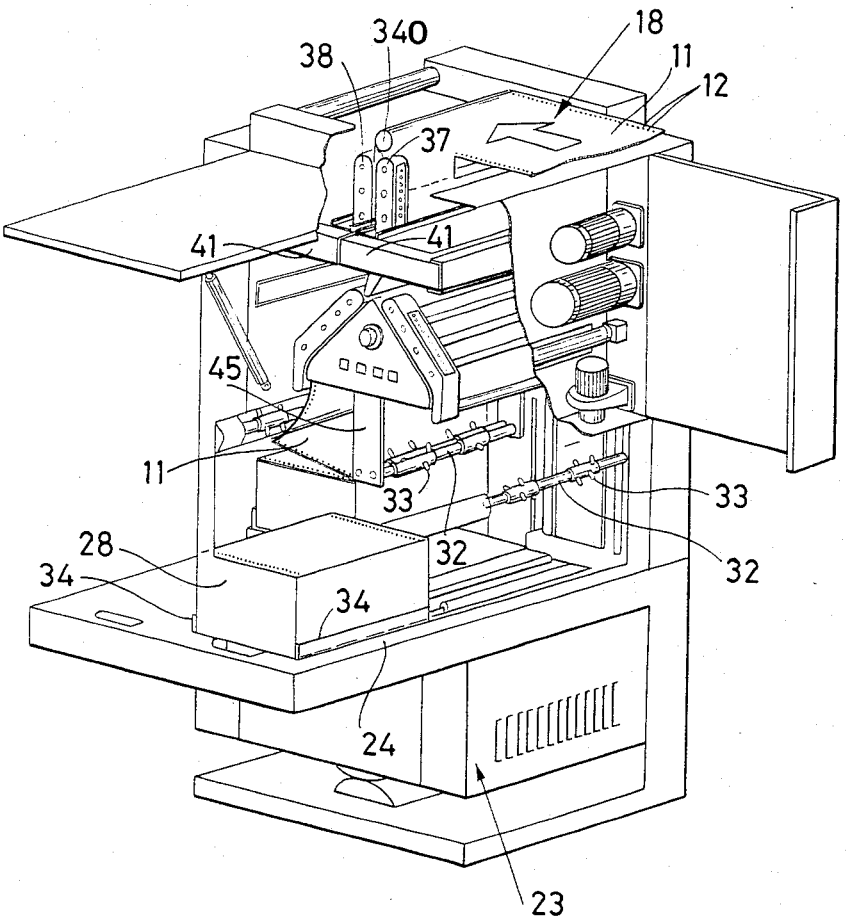

F
S
110
111
112
113
114
115
116
117
118
119
120
121
122
123
124
125
126
127
128
129
130
131
132
133
134
135
136

APPARATUS FOR RECEPTION AND TRANSFER OF SHEET MATERIAL

The present invention concerns an apparatus fit for receiving and transferring sheet material, united among themselves as a continuous strip and tearable, for example such as forms processed into data processing centers, electro-accounting stations etc. It is known that in recent years popularity and evergrowing diffusion have been acquired by electro-accounting and data processing systems, associated with computers, wherein the printing machines, especially fast printing machines such as the so called laser-printers, process preshaped forms (eventually pre-hollow-punched for the so called self-enveloping types) that are fed to the printing machine from form packages united as a continuous strip, with weakening or tearing lines between two forms, whenever it will be necessary separating the single forms upon processing completion.

Until now the forms as processed by the printing machine were collected still assembled among themselves into packages or piles which were thereafter manually taken and transferred to successive processings, with evident waste of time and manpower.

Taking into account that a fast printing machine, for example a laser-printer, exhausts a thousand form package with in few minutes, it is clear that dead times both in the loading of a new form package and in extracting the already processed form package will heavily affect the productivity of the printing machine and hence of the data processing center, very often in a measure above 50%.

Another aspect of the problem faced by the present invention and that cannot be overlooked is that such data processing and electro-accounting systems have been designed for and installed into ad hoc arranged cubicles, often equipped with conditioning for an optimum operation of electronic components, wherein the available space is minimal and structural modifications are not possible without radical changes to the whole system.

A further problem relative to apparatuses of this character is that connected with health, considering the danger to laser printing operators that have been evidenced by recent studies of work-medicine, hence the need for automated servicing devices for input and output from the printing machine.

Main purpose of the present invention is that of providing an automatic equipment, associated with the output of a data processing station printing machine, fit for receiving the printed forms or sheets, coming out of the printing machine as a continuous strip wherein the single sheets or forms are limited among themselves by borings or weakening lines for their tearing separation, and for collecting them shaped as packages that in turn will be automatically removed, without manual assistance.

Another purpose of the present invention is that of providing an equipment of the above said character fit for being assembled or associated with data processing stations of already existing types, without substantial modifications of the latter.

These and other purposes of the present invention are achieved through a reception and transfer apparatus for sheet material, united as a continuous strip and separable as single sheets by means of beforehand fixed tearing lines, characterized by the inclusion of guide means along a desired path, for the sheet continuous strip coming out from the processing station, controllable cutting means for cutting or tearing the strip in correspondence with a prefixed portion or position of said strip of sheets or forms and trolley means having a support plane progressively movable between a raised position for starting the loading of said folded forms coming from said guide means and a lowered position, corresponding to the loading of a prefixed quantity of forms shaped as a continuous strip, said cutting means being driven at least when said support plane reaches said lowered position, said trolley means being in addition movable between a loading operative position for the strip shaped forms and a transfer and unloading position wherein said package shaped forms are finally extracted from the equipment.

Figure 2:
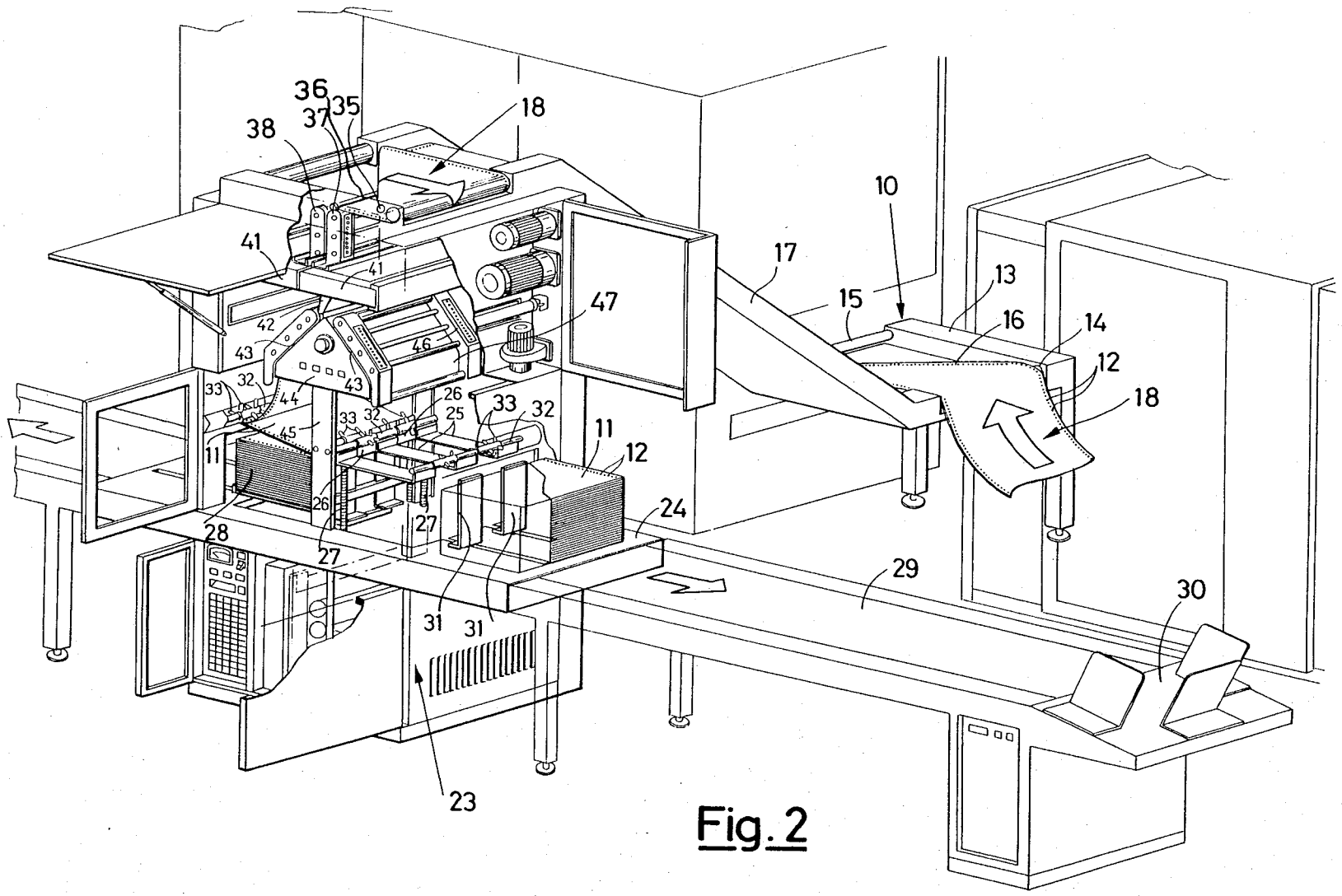
Figures 7, 8:
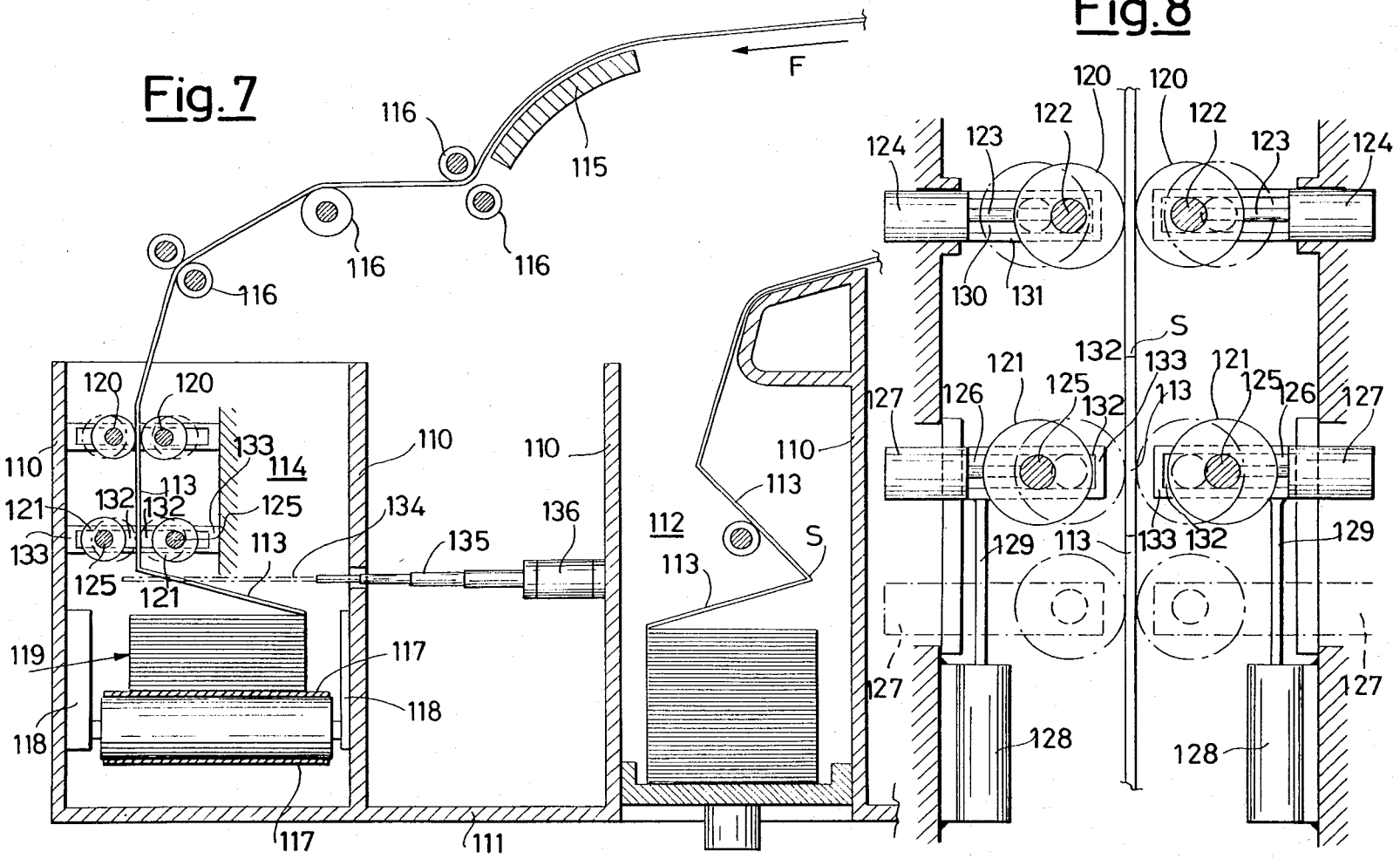

The peculiar features and advantages of the present invention will appear more clearly from the following detailed description, having exemplifying but not limiting purpose, with reference to attached drawings, wherein:

the FIG. 1 is a perspective, partially cross-sectional, view of the apparatus in accordance with the invention;

the FIG. 2 is a view of the apparatus of FIG. 1 in a modified version;

the FIGS. 3, 4, 5 and 6 show diagrammatically the operating succession of the apparatus of FIGS. 1 and 2 and the FIGS. 7 and 8 are diagrammatic cross sectional views of a further embodiment of the apparatus in accordance with the invention.

Referring primarily to FIGS. 1 and 2, there is shown a first embodiment of the invention, which in FIG. 2 is different from the FIG. 1 in that it provides a section 10 for receiving and guiding a paper strip 18 consisting of single sheets or forms 11, united between themselves throughout by means of cutting or tearing lines of conventional character and having laterally holes 12 whereby they are handled in a traditional manner within the printing machine and other processing and feeding equipments.

As it will be seen from FIG. 2, the receiving section 10 includes a frame 13 wherein there are housed the idle rollers 14 and 15, and a deviating roller 16, around which the strip 18 goes through and is thus deviated by 90° C. in its feed direction.

From the frame 13 an inclined plane 17 starts guiding the continuous strip 18 of sheets or forms coming out of the printing machine, not shown, by which rollers 14 and 15 fed.

The apparatus shown into FIGS. 1 and 2 includes a frame 23 consisting in a platform 24, onto which piling up and supporting means are provided that include, in the case of FIG. 2, the horizontal channel plates 25, assembled to and projecting from a transverse bar 26, which is integral, by rack connection, with two vertical shafts 27 which in a known manner cause the lowering step by step of plates 25, beginning from the higher initial position until the plates 25 are lowered by a distance corresponding to the desired dimension for the package (or ream) 28, wherein the sheets or forms 11, as already processed by the printing machine, are collected in a folded arrangement; to said desired dimension it corresponds a prefixed number (within certain limits) of forms or sheets that will be successively transferred, by means of the conveyor belt 29, to the bunching and switching plane 30.

The package 28 is translated from the bunching position to that of engagement by the conveyor belt 29 by means of a thrust device including the vertical plates 31, that run along guides provided on the platform 24, passing between the one and the other piling up plates 25, thus transferring with themselves the package 28, coming back thereafter to the initial position.

Above the plates 25 there are provided idle shafts 32, carrying the projecting parts 33, intended for guiding and correctly placing the forms 11 arriving on the piling means.

In the embodiment shown in FIG. 1, the sheets or forms 11 are instead piled up on supporting brackets 34, sliding on the platform 24 in a guided manner between a piling up position and a transfer position to, for example, a conveyor belt not shown, with intervention of thrusting means that operate on each package, when the latter is already completed and the piling up on the laterally alongsided position is already started.

Also in this case piling up is controlled by the idle shafts 32 that carry the projecting studs 33.

In the embodiment of FIG. 1, that concerns stations wherein the form strip 18 may arrive in alignment with the piling up positions, the section 10 of FIG. 2 is omitted (it will be instead useful for those systems wherein the form strip coming out of the printing machine must be deviated outside the alignment with the same printing machine).

Hence, in the case of FIG. 1, the strip 18 reaches an upper roller 340, by which it will be introduced within the very same piling up equipment, whereas in the embodiment of FIG. 2, the strip 18, arriving along the inclined plane 17, passes around the deviating roller 35, being thus deviated by 90° and then around roller 36 to enter within the very same equipment.

The latter includes a pair of form dragging conveyors 37 and 38 (of current character) wherein the forms are dragged by teeth members that engage the lateral holes 12, said teeth members being assembled to and rotated by rollers 39 and 40, (for each conveyor) driven in turn by motor means not shown.

Below the dragging conveyors 37 and 38, a pair of knives 41 is provided, fit for a sharp cutting according to a horizontal path.

To drive knives 41 there is provided a driving device of known and not shown character, controlled in turn by a counting device that may be programmed (for instance a device fit for counting the sheets or forms 11 that pass through the conveyor means in correspondence with a reader).

The operation of knives 41 depends obviously upon the consent by a control device, for example a photoelectric cell, which will ensure that knives 41 are operated in correspondence with the tearing prefixed line normally provided between one form and the other that constitute the strip 18.

Eventually the knife device 41 may the substituted with a tearing device as utilized in the embodiment shown in the FIGS. 7 and 8.

Below the knife device 41 a mechanical deviating member 42 is provided and not driven by means not shown in order to assume either one or alternatively the other between two positions wherein it will direct the form strip 18 coming from the conveyor means 37, 38 and passing through knives 41, on an inclined plane 43 consisting of triangular section support 44, mounted to the apparatus by means of struts 45.

The entrainment of the paper strip on the two inclined planes 43 is carried out by means of devices, having character known by itself, that will engage the form lateral holes 12, in the same way as the conveyors 37 and 38.

The triangular section support 44 includes moreover two vertical faces 47, forming an extension of the inclined planes 43 and having the scope of directing the strip 18 on the underlying support and piling up means.

Taking now into consideration the FIGS. 3–6, there is schematically illustrated the operational cycle of the apparatus in accordance with the invention.

Figure 3:
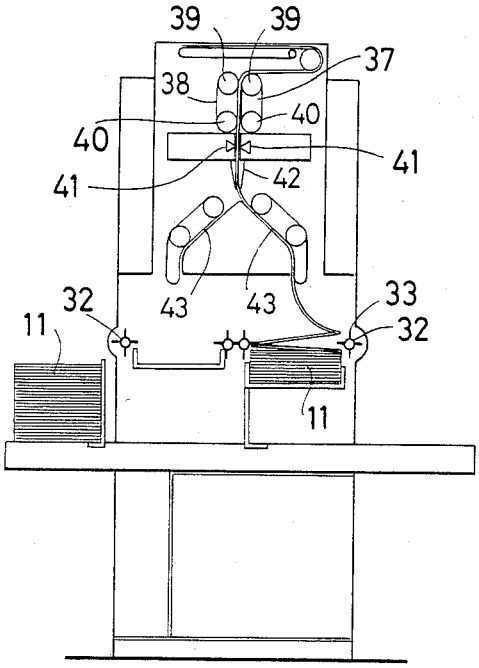
Figure 4:
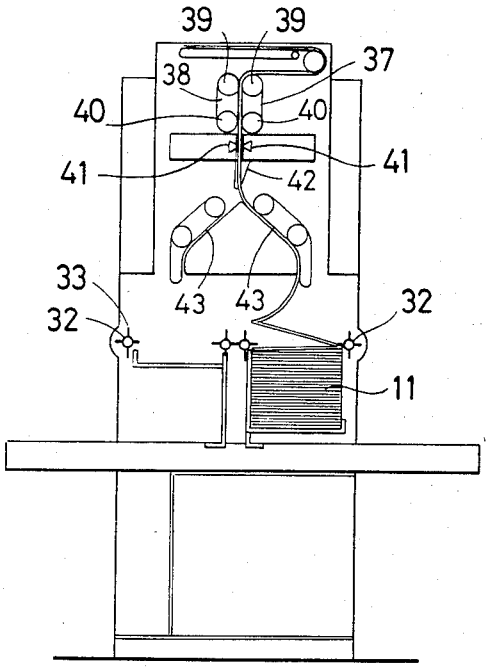
Figure 5:
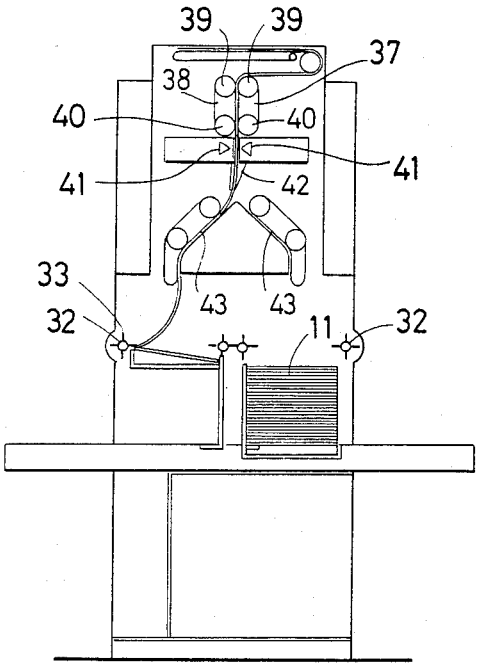
Figure 6:
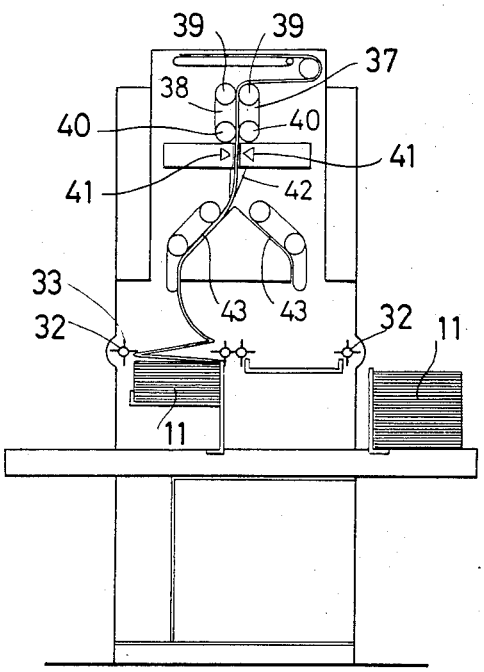

More specifically, in FIGS. 3 and 4 it is shown the succession, until the cutting has been accomplished, of the piling up of "folded" sheets or forms 11, on one side of the supporting and piling up means, whilst the FIGS. 5 and 6 show the initial phases of the piling up on the other side of the piling up means and the definitive removal of the form package as already formed during the cycle illustrated in FIGS. 3 and 4.

Reference will now be made to FIGS. 7 and 8, that illustrate another embodiment of the apparatus in accordance with the invention, respectively as a cross-section of the apparatus and an enlarged section of the sole cutting means.

Referring to the FIG. 7 there is shown a portion of the printing equipment, of the character normally utilized within data processing and electro-accounting centers, enclosed within a cubicle frame, wherein the partition walls are indicated with reference 110, while the bottom is indicated with the number 111 identifying a feeding compartment 112 for the sheets or forms 113 shaped as a continuous ribbon or strip and a receiving compartment 114.

As is customary, the sheets or forms 113, are united between themselved by weakening lines or holes "S" for the tearing.

As it will be noted, there is not even schematically shown the printing machine wherefrom the form or sheet strip 113 comes out as indicated by the arrow F, passing upon a deviating tile 115 and through pairs of guiding and dragging rollers 116, driven by motor means (not shown).

Within compartment 114, there are provided piling up means in form of a conveying belt 117, wherein the supports 118 are vertically movable between a completely raised initial position and a lowered final position.

The latter is fixed by control and counting means that may be programmed, including for example an optical reader located at the entry of compartment 114 and fit for counting the number of forms 113 that are piled up on the plane of the conveyor belt 117.

Hence on the conveyor belt 117 there will be built up a package 119 of prefixed dimension and containing therefore (within limits depending upon calibration and sensitiveness of the control and counting means) a desired number of forms already processed by the printing machine and ready for the successive operations (tearing, enveloping, etc.).

When the supports 118 of the conveyor belt 117 reach the lowered position the belt is forwarded by the distance necessary to bring the completed package 119 outside the compartment 114.

In order to cut the form strip or ribbon 113 there is provided, within the compartement 114, upstream of the strip received in 117, a tearing device including a pair of upper rollers 120 and a pair of lower rollers 121.

The upper rollers are assembled to studs 122, stiffly integral with bars 123 extensible and retractable in respect to driving cylinders 124, and studs 122 will run inside slots 130 formed within the brackets 131.

Therefore, as shown in FIG. 8, the rollers or cylinders 120 are movable between a resting position, shown in dotted lines, and an operational position, wherein they engage and catch the form strip 113.

The lower rollers 121 are assembled to studs 125 also integral with horizontal bars 126 extensible and retractable as the bars 123, in respect to cylinders 127, and the studs 125 being slidable inside slots 132 formed within the brackets 133.

In this instance, however, the assembly comprising the cylinders 127, bars 126, studs 125 and rollers 121 is movable between a raised or resting position (shown with full lines in the FIG. 8), and a lowered or operational position (shown with dotted lines in the FIG. 8).

To this end there is provided a pair of cylinders 128, having pistons and rods stiffly integral with the above said assemblies.

The operation of the tearing device is as follows:

When a package 119 of forms 113 having the desired size has been formed on the conveyor belt 117, the roller pairs 120 and 122 are simultaneously driven to clamp the form or sheet 113, so that between the upper rollers and the lower ones there will be a tearing line between two adjacent forms (generally indicated by the reference S), whereby the vertical distance between the upper rollers 120 and the lower ones 121 should be lower than the dimension of one form 113.

By operating at this point the cylinders 128, so as to withdraw the rods 129, a tearing action will be applied to the form 113 so that the two forms 113, respectively engaged by the roller pairs 120 and 121, are separated between themselves, thus interrupting the form strip continuity.

The conveyor belt 117 is now operated to take away the processed package 119 and hence the free end of form strip 113, once the rollers 120 and 121 have been stopped, and can recommence laying itself on the conveyor belt 117.

With a view to ensure a safe operation of the apparatus and considering the high progressing speed of the form strip 113 while the conveyor belt 117 is moving away a complete package, under the roller pair 121 there is temporarily and automatically placed a retractable support plate, indicated with the reference 134, operated by a piston having a rod 135 movable into a driven cylinder 136.

It is evident that the plate 134 serves the purpose of receiving for some instants the forms coming from the roller pair 121.

In the meantime the supports 118 of the conveyor belt 117 are restored to the initial position wherein the conveyor belt 117 is under and substantially in contact with plate 134 and the latter can be extracted, thus releasing the already assembled forms on the plane of the conveyor belt 117.

The merits of reliability and easyness of the device in accordance with the invention appear evident by themselves.

Equally evident is that changes and modifications mechanically and conceptually equivalent are possible and foreseeable without falling out of the scope of the invention.

For example, instead of the driving cylinders 124 and 127, there can be provided driving electro-magnetic devices. Similarly to the roller pairs 120 and 121 serving solely the purpose of clamping two forms 113, a cutting knife device can be associated, synchronized with the advance motion of the forth strip and subordinated to the completion of a form package on the support and transfer belt 117. It is clear that through the conveyor belt 117 the packages may be transferred and directed to other desired conveying means.

From the previous description it appears finally clear that by the present invention there are made automatic and continuous the reception and transfer of forms coming out as a continuous strip (tearing separable as single sheets) from a printing machine, thus avoiding work slackenings within the printing station and avoiding the staying of operators in proximity of the printing machine.

I claim:

1. Apparatus for the reception and transfer of sheet material, united as a continuous strip and separable as single sheets by means of prefixed tearing lines, comprising:

means for guiding in accordance with a desired path said continuous strip;

control operated cutting means to carry out the cutting or tearing of the strip correspondingly to a position or prefixed portion of said strip and supporting and piling up means, having a piling up plane movable between a raised position for starting the folded piling up of said strip that comes out of said guiding means and a lowered position, corresponding to the piling up of a prefixed quantity of forms shaped as a continuous strip;

said cutting means including a knife pair operative for cutting the strip passing between the two knives;

said supporting and piling up means including two independent planes, movable between said raised position and lowered position, said planes being alternately fed by said strip that is laid down in a folded configuration; and a guide assembly including a mechanical deviating member and two symmetrical inclined planes provided upstream of said planes for respectively directing the strip towards one or respectively the other of said planes, and said inclined planes including guided dragging means for said strip, said mechanical deviating member being driven in such a way that it will direct the strip on one or the other said inclined planes;

said piling up planes including channel shaped horizontal plates projecting from a common lateral bar, the latter being upwards and downwards slidable in a driven manner;

said cutting means being operated at least when said piling up plane reaches said lowered position;

said piling up means being moreover movable between an operational position, wherein the piling up is carried out, and a transfer and unloading position wherein the form package will be finally extracted from the apparatus;

said guiding means including roller means and conveyor means that direct said strip through said cutting means;

said conveyor means including toothed carrier belts that engage edge holes provided within the single sheets constituting the strip;

said support and piling up means including a conveyor belt being movable on control and for a prefixed time; and a piling up and temporary support plate, controlledly movable between a rest or retracted position and an operating position between said conveyor belt and said second pair of rollers.

2. Apparatus in accordance with claim 1, characterized by that said cutting means are tearing means including a first roller pair movable between a resting position and an operational position wherein they clamp the strip passing through them, and a second roller pair, located downstream of said first pair with reference to the strip advancing path, the rollers of said second pair being movable singly between a resting position and an operational position wherein they lock the strip passing through them, said second roller pair being movable between a resting position and a fast moving-away position, downstream with reference to the motion direction of said strip, in respect to said first roller pair.

* * * * *